US006851827B2

(12) United States Patent
Clemente et al.

(10) Patent No.: US 6,851,827 B2
(45) Date of Patent: Feb. 8, 2005

(54) SUBMERSIBLE LANTERN

(75) Inventors: Kurt J. Clemente, Chesapeake, VA (US); John M. Vrooman, Hampton, VA (US)

(73) Assignee: Nortrhop Grumman Corporation, Newport News, VA (US)

( * ) Notice: Subject to any disclaimer, the term of this patent is extended or adjusted under 35 U.S.C. 154(b) by 129 days.

(21) Appl. No.: 10/201,058

(22) Filed: Jul. 22, 2002

(65) Prior Publication Data

US 2004/0012953 A1 Jan. 22, 2004

(51) Int. Cl.[7] ..... F21L 4/00; F21V 31/00

(52) U.S. Cl. ..... 362/158; 362/101; 362/183; 362/200; 362/399; 362/293

(58) Field of Search ..... 362/101, 158, 362/183, 184, 200, 399, 293, 186, 267, 375

(56) References Cited

U.S. PATENT DOCUMENTS

| | | | | | |
|---|---|---|---|---|---|
| 3,441,730 | A | * | 4/1969 | Doring et al. | |
| 3,689,759 | A | * | 9/1972 | Dill | 240/10.69 |
| 3,794,825 | A | * | 2/1974 | Krupansky | 240/10.63 |
| D250,428 | S | * | 11/1978 | Bennett | D48/20 K |
| 4,237,526 | A | * | 12/1980 | Wood | 362/158 |
| 5,016,151 | A | * | 5/1991 | Mula | 362/267 |
| 5,117,341 | A | * | 5/1992 | Huang | 362/184 |
| 5,535,107 | A | * | 7/1996 | Prok | 362/158 |
| 5,667,293 | A | * | 9/1997 | Own | 362/184 |
| 5,871,272 | A | * | 2/1999 | Sharrah et al. | 362/184 |
| 6,086,218 | A | * | 7/2000 | Robertson | 362/157 |
| 6,168,288 | B1 | * | 1/2001 | St. Claire | 362/184 |
| 6,280,051 | B1 | * | 8/2001 | Wallach | 362/202 |
| 6,371,625 | B2 | * | 4/2002 | Campman | 362/184 |
| 6,445,132 | B1 | * | 9/2002 | Ford | 315/56 |
| 6,547,414 | B2 | * | 4/2003 | Steger | 362/188 |
| 6,629,767 | B2 | * | 10/2003 | Osiecki et al. | 362/202 |

OTHER PUBLICATIONS

MIL–DTL–16377/53B(SH), "Fixtures, Incandescent, Detail Lighting, Lantern, Hand, Portable and Relay Watertight Symbols 100.2, 101.2, 101.3, 102.2, and 108", *Detail Specification Sheet*, Nov. 25, 1996, pp. 1–27.

* cited by examiner

*Primary Examiner*—Thomas M. Sember
*Assistant Examiner*—Jacob Y. Choi
(74) *Attorney, Agent, or Firm*—Hunton & Williams

(57) ABSTRACT

A lantern is provided that comprises a case having a plurality of walls defining a case interior. The plurality of walls includes opposing front and rear walls. A lighting port is formed through the front wall and a faceplate assembly is disposed in the case interior in substantial registration with the lighting port. The faceplate assembly is disposed so that it engages a portion of the front wall surrounding the lighting port to seal the lighting port. A solid-state illuminator assembly is disposed in the case interior in substantial registration with the faceplate assembly and in contact with the faceplate assembly. A bracing arrangement is disposed intermediate the solid-state illuminator assembly and the rear wall. The bracing arrangement is in contact with the solid-state illuminator assembly and is configured to restrict rearward movement of the solid-state illuminator assembly and the faceplate assembly.

23 Claims, 3 Drawing Sheets

SUBMERSIBLE LANTERN

FIELD OF THE INVENTION

The present invention relates generally to portable lighting systems and more particularly to battery powered lanterns that are operable under water and in dirty, oily, smoke-filled, water-sprayed environments.

BACKGROUND OF THE INVENTION

Hand-portable and relay-operated watertight lighting fixtures (battle lanterns) have been used aboard U.S. Navy ships for decades. These lanterns provide numerous functions including passageway and compartment egress lighting in the event of loss of normal lighting, illumination of safes, secure items and important dials, gauges and controls in the event of loss of normal lighting, inter-compartment navigation in the presence of smoke, spray or flooding, and various other portable lighting tasks. The duties of the battle lantern necessitate a level of functionality not required of a standard civilian flashlight. Required characteristics include extreme ruggedness, submersibility and shock-resistance.

Existing battle lanterns typically have a water-tight compartment in which a power supply is housed. The power supply generally comprises one or more rechargeable or non-rechargeable batteries, which are electrically connected to an incandescent lamp through a manual switch or automatic relay. The internal compartment is formed by an outer case having a light port on its forward face. A significant aspect of current lanterns is that the light port is filed and sealed by the lens portion of the incandescent lamp in combination with a sealing gasket. An exemplary lamp used in current lanterns is a 2.35-Watt GE or Philips PAR-36 parabolic reflector incandescent bulb with a tempered glass casing for shatter-resistance.

SUMMARY OF THE INVENTION

The incandescent lamps of current battle lanterns have significant disadvantages in terms of lamp life, battery drain, ruggedness and overall operational cost. The objectives of the present invention therefore include providing a battle lantern that produces a level of luminescence and submersibility comparable to those of current lanterns while: reducing power requirements as compared to current lanterns, thereby enhancing battery life; increasing the life of the illumination source over that of the present incandescent lamp; enhancing the usability of the illumination provided by the illumination source; and enhancing ruggedness and shock resistance.

Toward these ends, an embodiment of the present invention provides a lantern comprising a case having a plurality of walls defining a case interior. The plurality of walls includes opposing front and rear walls. A lighting port is formed through the front wall and a faceplate assembly is disposed in the case interior in substantial registration with the lighting port. The faceplate assembly is disposed so that it engages a portion of the front wall surrounding the lighting port to seal the lighting port. A solid-state illuminator assembly is disposed in the case interior in substantial registration with the faceplate assembly and in contact with the faceplate assembly. A bracing arrangement is disposed intermediate the solid-state illuminator assembly and the rear wall. The bracing arrangement is in contact with the solid-state illuminator assembly and is configured to restrict rearward movement of the solid-state illuminator assembly and the faceplate assembly.

Other objects and advantages of the invention will be apparent to one of ordinary skill in the art upon reviewing the detailed description of the invention.

DETAILED DESCRIPTION OF THE INVENTION

Figure 1:
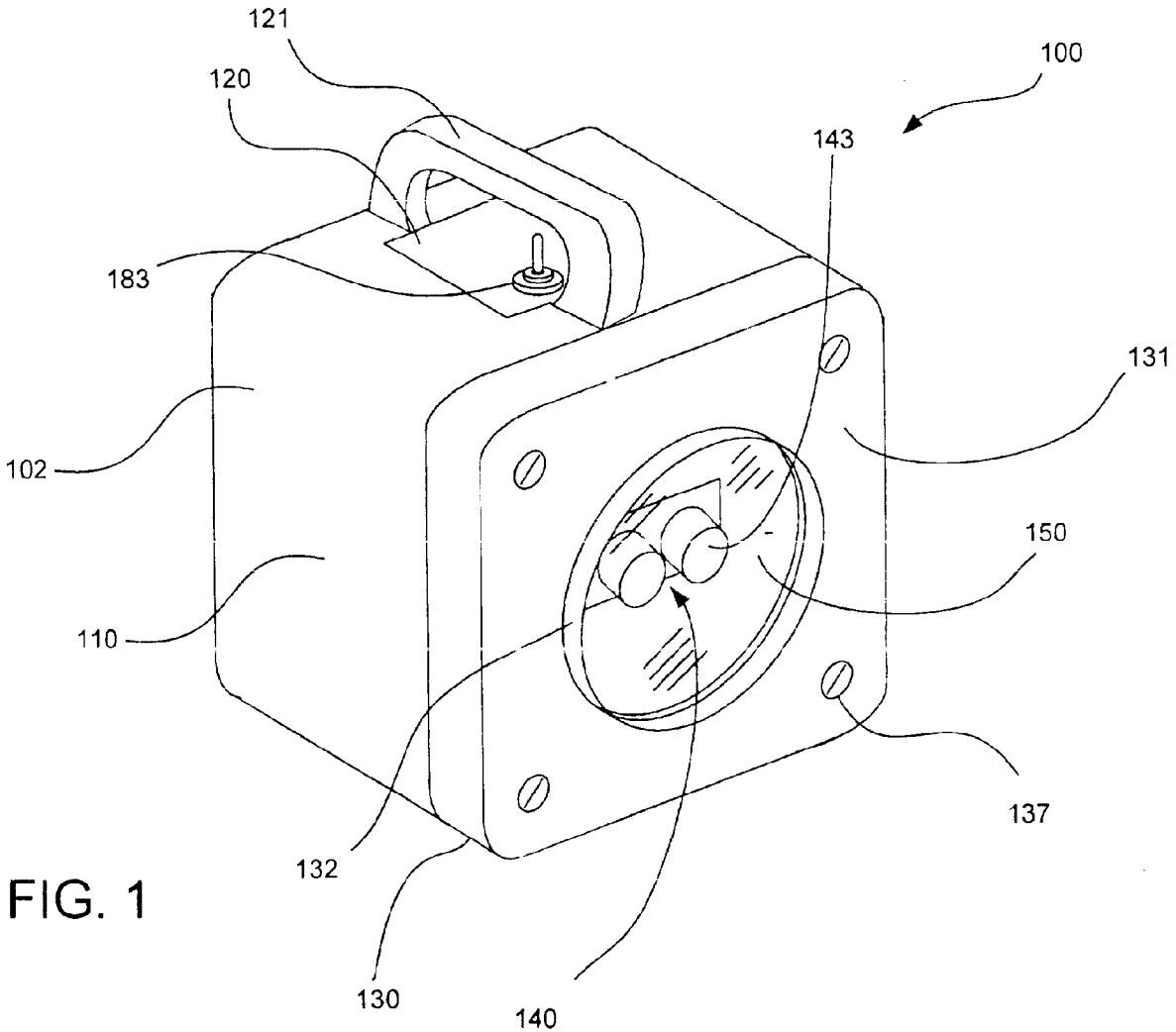
FIG. 1 is a perspective view of a submersible lantern according to an embodiment of the invention.

The present invention provides a lantern having a light output equivalent to the existing incandescent bulb battle lanterns by replacing the incandescent bulb with high intensity LEDs. The invention contemplates the use of the case and other hardware of existing battle lanterns produced in accordance with Military Specification MIL-DTL-16377/53B and all historic, superseded or other similar specifications. Lanterns according to the present invention may be produced from new hardware manufactured in accordance with MIL-DTL-16377/53B or from new hardware manufactured to different specifications.

LEDs have a number of highly significant advantages over incandescent bulbs or lamps. First, they have a significantly higher operational life. The incandescent lamp of current lanterns is typically rated by the manufacturer as having a 100 hour lifetime. The LEDs of the type used in the present invention may have an operational as high as 100,000 hours. It is therefore likely that LEDs used in a lantern according to the present invention will never require replacement during the service lifetime of a newly constructed ship.

LEDs can be used to produce a wider beam than the parabolic reflector incandescent lamps typically used in flashlights and lanterns. Incandescent lantern lamps typically use a parabolic reflector to increase light intensity. This typically results in the lantern being able to illuminate a six inch by six inch square from ten feet away. In contrast, an array of LEDs can produce a similar level of illumination over a six foot by six foot square while using less power.

The biggest advantage of LEDs over incandescent lamps is their ability to produce a comparable level of luminescence using significantly less power. The reason for this is that the process by which solid-state materials are stimulated to generate light converts very little input power to heat as compared to heated-filament process of incandescent lamps. The result is a significant increase in battery life, which in turn dramatically reduces life cycle cost of the lantern.

Another significant advantage of LEDs, particularly in military applications, is that LEDs are inherently resistant to the effects of high impact shock. By comparison, incandescent lamps are relatively fragile.

Accordingly, the use of LEDs in military lantern applications is highly desirable. Unfortunately, removal of the incandescent lamp from current military battle lanterns creates a number of difficulties that must be overcome. The lamp is an essential structural component of the current battle lanterns, contributing in large part to the ruggedness and watertight characteristics of the lantern. In these lanterns, the lamp is situated adjacent a front cover having a lighting port formed therethrough. A tempered glass "lip" of the lamp and a rubber gasket are pressed against a shoulder that forms the outer circumference of the lighting port. The bulb is secured in place by a lamp retainer that is fastened to the front cover by machine screws. The lamp retainer provides a compressive load that forces the bulb and gasket against the shoulder of the front cover to produce a water-tight seal.

The incandescent lamp of the current lantern thus serves a significant function in keeping the lantern water-tight. The lamp also serves to enhance the structural ruggedness of the lantern.

Replacement of the incandescent lamp of the current battle lanterns with LEDs thus requires that the structural and sealing contributions of the incandescent lamp be provided by other means. The present invention provides a lantern with a structural configuration that allows the use of an array of one or more LEDs as the illumination source of the lantern while maintaining and even enhancing the sealing and ruggedness (i.e., shock resistance) characteristics of the lantern. This structural configuration also serves to brace power supply components such as batteries against movement within the lantern case. This is significant because even a small degree of movement of the batteries has been shown to be a significant contributor to failure of the current lantern when the lantern is exposed to shock environments.

A lantern according to the present invention comprises a case having a main housing and a detachable front cover. The main housing of the case includes top, bottom and rear walls and first and second side walls that collectively define an interior in which is mounted a power source such as a battery. The front cover of the case includes a lighting port through which light from the lantern's illumination source passes. The lighting port is closed off by a flat, transparent face plate surrounded by an elastomeric seal. The illumination source of the lantern is an array of one or more LEDs attached to a rugged mounting plate. This mounting plate is slidably disposed within a retaining ring attached to the inside surface of the front cover. The mounting plate is positioned so that the forward face of the LEDs are in contact with the inside surface of the transparent face plate. The mounting plate is maintained in this position by a bracing arrangement comprising one or more expansive components disposed between the rear of the mounting plate and the power source or other components disposed in the case interior. The expansive components are configured so that when the lantern is assembled the expansive components are compressed so as to provide a an rearward retaining force for the power source or other components in the case interior and a forward retaining force on the mounting plate, LED array and the faceplate. These retaining forces serve to prevent significant movement of the lantern components in the event of shock. The forward retaining force also serves to establish and maintain a substantially water-tight seal between the faceplate and the front cover.

Figure 2:
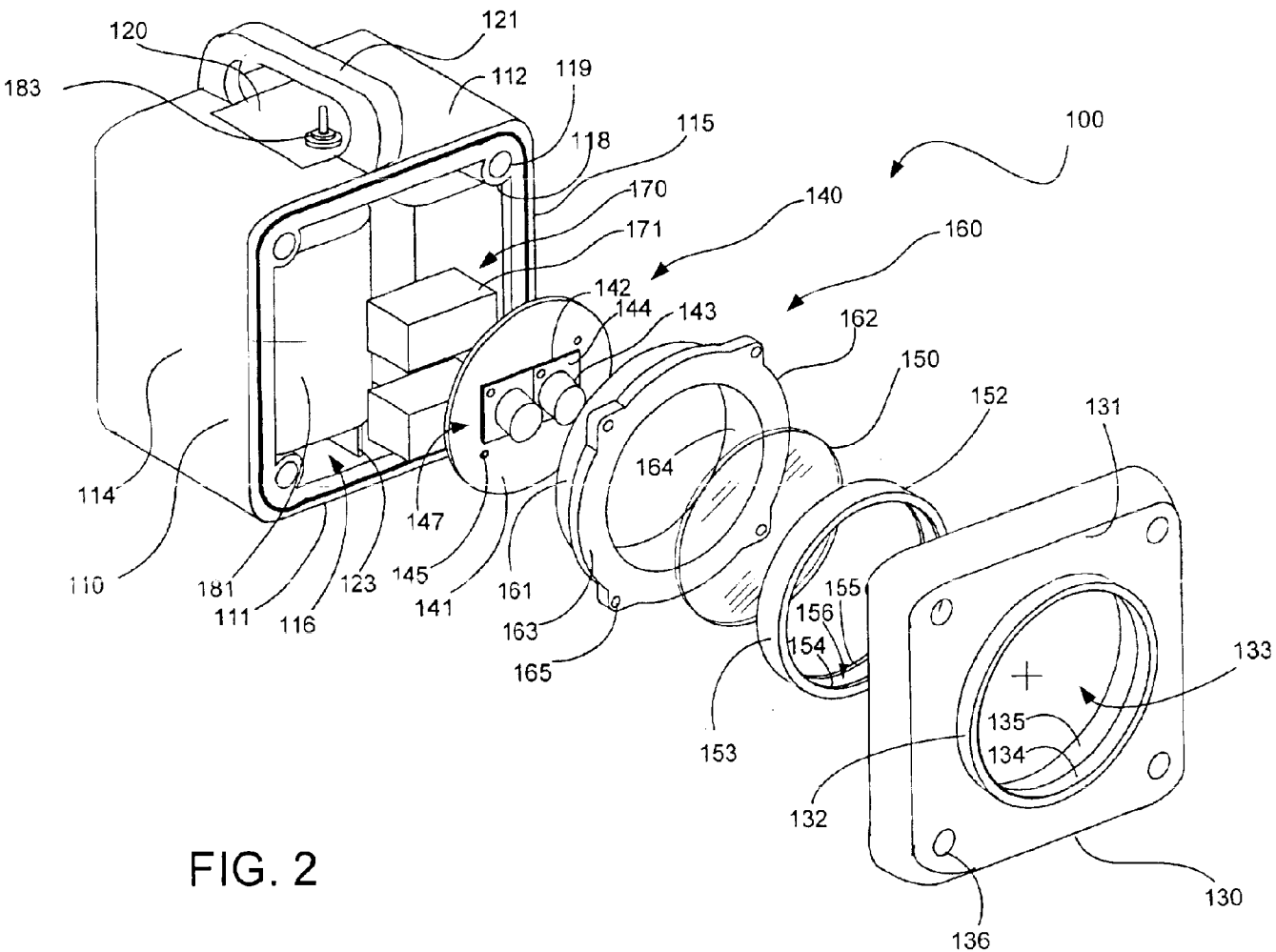
FIG. 2 is an exploded view of a submersible lantern according to an embodiment of the invention.
Figure 3:
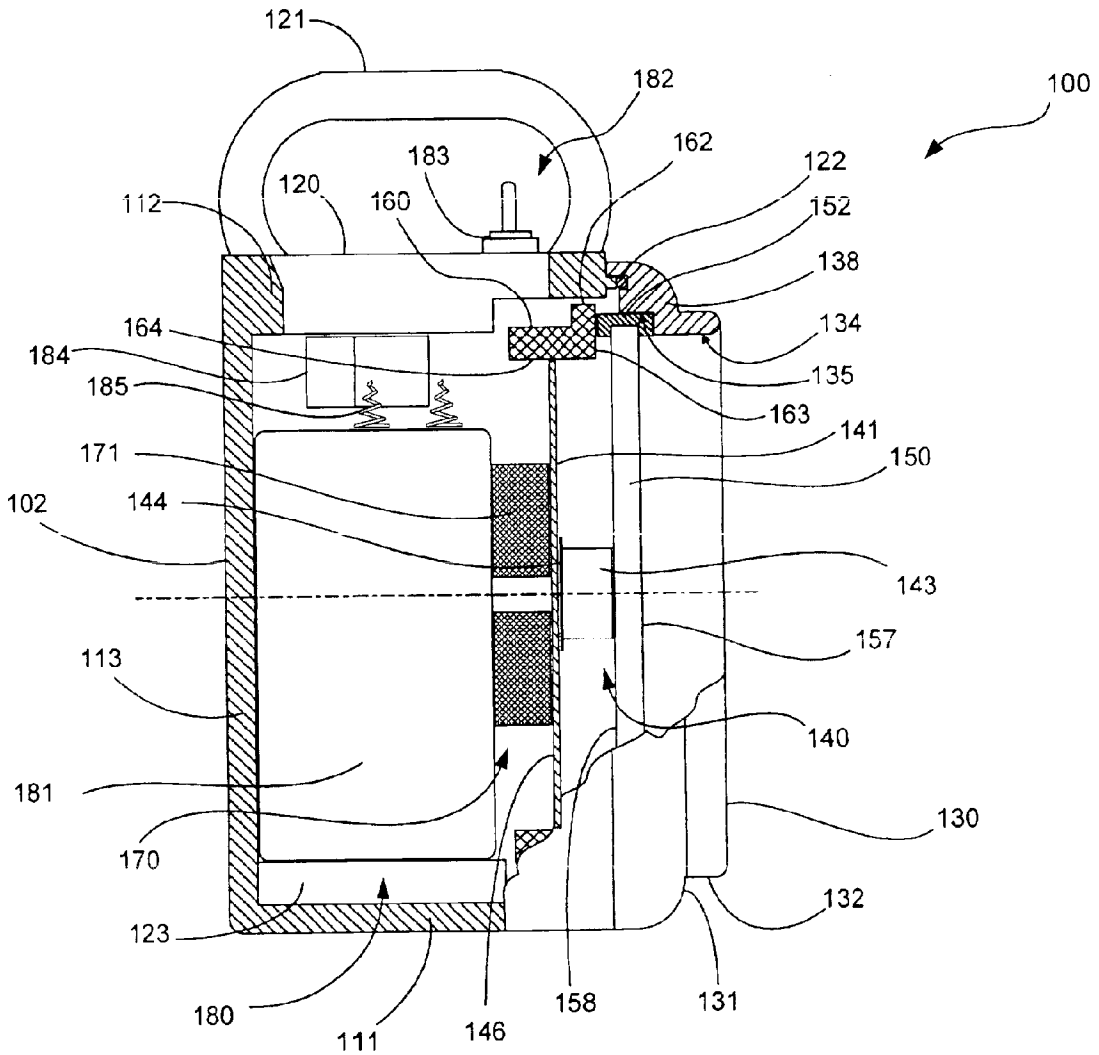
FIG. 3 is a partial section view of a submersible lantern according to an embodiment of the invention.

The invention will now be discussed in more detail. With reference to FIGS. 1–3, a lantern 100 according to an embodiment of the present invention includes a case 102 having a lighting port 133, a faceplate 150 and associated faceplate seal 152, a retainer 160, an illuminator assembly 140 in electrical communication with a power supply 180, and an expansive bracing arrangement 170.

The case 102 comprises a main housing 110 and a front cover 130. The main housing 110 is formed by opposing top and bottom walls 112, 111, opposing first and second side walls 114, 115 and a rear wall 113 that combine to define a case interior 116. The housing 110 is preferably formed from a rigid, high strength, preferably non-conductive structural material such as molded plastic or a structural composite material. In some embodiments, metal may also be used. The case interior is sized and configured for the secure disposition of a power supply 180 therein. As will be discussed in more detail hereafter, the power supply 180 typically comprises one or more batteries 181. As shown in FIGS. 2 and 3, power supply supports 123 may be attached to or integrally formed with the bottom wall 111. The structure of the main housing 110 includes substantially cylindrical corner fills 118 with threaded fastener holes 119 formed therein for use in securing the front cover 130 to the main housing 110.

Although the main housing 110 is shown as a rectangular block structure having five distinct rectangular walls, it will be understood by those of ordinary skill in the art that other shapes and wall configurations may be used without departing from the scope and spirit of the present invention. The main housing 110 may, for example, be formed as a hollow right circular cylinder having an open end.

The top wall 112 may be formed with an access opening closed and sealed by a removable access cover 120. The access opening allows access to the power supply 180, switch assembly 182 or other internal components without disassembly of the case 102 and the illumination components of the lantern 100.

The front cover 130 has a front wall 138 defining a front face 131. The front cover 130 is sized and configured to mate with the forward faces of the top, bottom and side walls 112, 111, 114, 115 of the main housing 110 to effectively form a forward wall of the case 102. The front cover 130 is configured for removable attachment to the main housing 110 through the use of machine screws 137. The machine screw 137 are inserted through fastener holes 136 and threaded into the threaded fastener holes 119 of the main housing 110. A front cover gasket 122 is positioned intermediate the front cover 130 and the main housing 110 to assure a water-tight seal when the screws 137 are tightened.

The front wall 138 has a circular lighting port 133 formed therethrough. The lighting port 133 is defined by a forward cylindrical port surface 134 and a coaxial rearward cylindrical port surface 135. The diameter of the rearward cylindrical port surface 135 is larger than the diameter of the forward cylindrical port surface 134.

The lantern 100 includes a substantially transparent faceplate 150 that is sized and configured to seal the lighting port 133 and allow light from the lantern's illumination source to pass through the lighting port 133. The faceplate 150 is preferably formed as a circular disc having flat forward and rearward surfaces 157, 158. The faceplate 150 may be formed from any transparent structural material having sufficient strength to withstand anticipated pressure loads and shock environments and sufficient temperature resistance characteristics to maintain structural integrity in anticipated heating environments. Usable materials may include tempered glass, acrylic resins such as Plexiglas® and other synthetic resins. Particularly preferred materials include polycarbonates such as Lexan® or Tuffak®. Polycarbonates are highly preferred in lanterns that are expected to function in extreme temperature environments.

It will be understood that other faceplate geometries can be used. For example, to enhance its structural capability, the faceplate 150 can be curved in a manner similar to the curvature of the lens portion of an incandescent lamp. This approach, however, introduces additional complexity and manufacturing cost that, given the strength of the materials from which the faceplate 150 may be manufactured, is generally not likely to be warranted.

The faceplate 150 is preferably formed so as to transmit light with as little loss as possible. A transmissivity in a range of 0.5 to 1.0 may be acceptable depending on the brightness of the light source. A transmissivity in a range of 0.7 to 1.0 is preferred and in a range of 0.85 to 1.00 is most preferred. The transmissivity of the faceplate 150 is determined by the material used and by the thickness of the faceplate 150. For a given material, the thickness of the faceplate 150 is determined by the desired degrees of submersibility and shock resistance. In general, usable faceplate thicknesses range from about 0.0625 in. to about 0.5 in. The thickness is preferably in a range from about 0.25 in. to about 0.35 in. An exemplary lantern 100 having a 0.375 inch thick, 4.375 inch diameter polycarbonate faceplate 150 has been shown to withstand a shock acceleration greater than 150 g (1471 m/sec$^2$) and to be submersible in water to a depth of 15 feet. The transmissivity of this face plate 150 was about 0.85.

The material of the faceplate 150 may be tinted to any desired color to change the color of light transmitted from the illumination source of the lantern. Tinting is most likely to be used in conjunction with a white illumination source to produce colored light. Light of virtually any color can be produced in this manner. Colored light may also be produced through the use of LEDs that use specific bandgap LED materials that produce light of a desired color. With such LEDs, the faceplate 150 may be substantially clear (i.e., untinted) or may be tinted to work in conjunction with the LEDs to produce a particular color.

The faceplate 150 is disposed within an elastomeric faceplate seal 152. The faceplate seal 152 is formed as an annular ring having a cylindrical outer surface 153 and a cylindrical inner surface 156. Forward and rearward lips 154, 155 extend radially inward from the inner surface 156. The inner surface 156 and the forward and rearward lips 154, 155 are sized to fit around the circumference of the faceplate 150 with the forward and rearward lips 154, 155 in contact with the forward and rearward faceplate surfaces 157, 158 respectively. The cylindrical outer surface 153 is sized to allow at least a portion of the combined faceplate 150 and seal 152 to fit concentrically within the rearward portion of the lighting port 133 of the front cover 130. The outer surface 153 of the faceplate seal 152 has a diameter that is larger than the diameter of the forward cylindrical port surface 134 of the front cover 130 so that when the combined faceplate 150 and faceplate seal 152 are positioned within the lighting port 133, the forward surface of the faceplate seal 152 contacts the shoulder between the forward and rearward cylindrical port surfaces 134, 135 and seals the lighting port 133. As will be discussed in more detail hereafter, forward pressure is applied to the faceplate 150 and faceplate seal 152 to enhance the integrity of the lighting port seal.

The faceplate seal 152 may be formed from any suitable elastomeric material including natural and synthetic rubbers and synthetic plastics.

In order to protect the faceplate 150 from impact, the front cover 130 may include an annular face extension 132 extending forward from the forward face 131 of the front cover 130. The face extension 132 is preferably integrally formed with the front wall 138 of the front cover 130.

The lantern 100 includes a retainer 160 that is removably attachable to the front cover 130. The retainer 160 has an annular cylindrical retainer body 161 with a retainer flange 162 attached to its forward end. The retainer 160 has a passage formed therethrough, the passage being defined by a cylindrical inner retainer surface 164. The retainer 160 is attached to the front cover 160 using machine screws or other threaded fasteners (not shown) that are inserted through fastener holes 165 formed through the retainer flange 162 and threaded into complementary threaded holes (not shown) in the rear of the front cover 130. As shown in FIG. 3, when the retainer 160 is attached to the front cover 130, the forward face 163 of the retainer 160 engages the faceplate seal 152. This serves to hold the faceplate 150 and faceplate seal 152 in place prior to attachment of the front cover 130 to the main housing 110.

The illuminator assembly 140 includes a circular mounting plate 141 to which an LED array 147 is attached. The LED array 147 comprises one or more electrically connected LED assemblies 142. Each LED assembly 142 includes a focused high intensity LED 143 such as those produced by Lumileds Lighting LLC, Nichia Corporation and Toshiba Corporation attached to a printed circuit board 144. Each LED 143 has a substantially cylindrical body that extends outward from the printed circuit board 144 and terminates in a flat surface through which the majority of the light from the LED 143 is emitted. Any number of LED assemblies 142 may be used. The number and size of the LEDs 143 is determined by the available space in the lantern and the total luminescence desired. The LED array 147 may comprise a large number of relatively small LEDs 143 or as few as one or two larger LEDs 143.

It will be understood by those of ordinary skill in the art that the size and number of LEDs 143 required may also be a function of the light color produced. For example, red light producing LEDs tend to be significantly brighter than white light producing LEDs of comparable size. An exemplary embodiment of the lantern 100 uses two Lumileds Luxeon model LXHL-NH94 red LEDs. These LEDs are approximately one inch in diameter and one inch in length. The luminescence produced by this array when connected to a six volt power supply is comparable to that of a second exemplary embodiment of the lantern 100 that uses an array of four Lumileds Luxeon model LXHL-NW98 white LEDs, which are similar in size. The illumination provided by both exemplary lanterns is in the range of about 20–30 foot-candles at a distance of 10 feet and of about 5–10 foot-candles at a distance of 20 feet.

Each LED assembly 142 may be separately attached to the mounting plate 141 through the use of threaded fasteners or by bonding. The mounting plate 141 is formed as a rigid thermally conductive disc. The mounting plate 141 is preferably brass but may be formed from other high strength, high thermal conductivity metal. The mounting plate thickness is preferably in a range of about 0.0625 inches to about 0.250 inches.

The mounting plate 141 is sized so that the entire illuminator assembly 140 may be slidably disposed within the cylindrical passage through the retainer 160. The diameter of the mounting plate 141 should be closely matched to the diameter of the retainer passage inner surface 164 so that movement of the illuminator assembly 140 is constrained to movement along the axis of the cylindrical retainer passage. The illuminator assembly 140 is positioned so that the forward faces of the LEDs 143 are in contact with the rear surface 158 of the faceplate 160.

The power supply 180 of the lantern 100 may be any suitable renewable or non-renewable power source but preferably comprises one or more DC batteries. The power supply 180 of an exemplary embodiment of the lantern 100 may include one or two six volt alkaline batteries 181. In another exemplary embodiment, the lantern 100 may include a single rechargeable battery 181 and a transformer to facilitate recharging of the battery 181.

The power supply 180 is part of a circuit that includes a switch 182 and the LED array 147. The power supply 180 is connected to the LED array 147 by wires that are passed through a plurality of wiring holes 145 formed through the mounting plate 141. (Note: In order to enhance the visibility of the relationships of the various elements of the lantern 100, the wires for the LED array 147 are not shown.) The power supply 180 may be electrically connected to the switch 182 by contact plates 184 that engage the power supply contacts 185 as shown in FIG. 3. Resistors may be added to the circuit to bias the voltage or limit the current from the power supply. It will be understood that other electrical circuit arrangements can be used without departing from the scope of the present invention.

The switch 182 may include a manual toggle or button switch 183 mounted to the case 102 of the lantern 100. The lantern is witched on by simply using the switch 183 to complete the circuit through the power supply 180 and the LED array 147. In an alternative embodiment, operation of the lantern may be remotely or automatically operated through the use of a relay arrangement. In this embodiment, the relay is set so that the operational circuit remains open as long as the relay is energized. If power to the relay fails, the circuit is closed and the lantern is switched on. This embodiment may also include a switch that bypasses the relay arrangement or breaks power to the relay, thus closing the circuit and turning on the lantern.

The lantern 100 includes a bracing arrangement 170 disposed intermediate the illuminator assembly 140 and the rear wall 113 and preferably intermediate the illuminator assembly 140 and the power supply 180. The bracing arrangement 170 serves to restrict rearward translation of the illuminator assembly 140 and preferably applies a forward load to the illuminator assembly 140 to assist in maintaining sealing contact between the combined faceplate 150 and faceplate seal 152 and the front cover 130. When disposed intermediate the illuminator assembly 140 and components of the power supply, the bracing arrangement serves to restrict forward movement of those components.

It will be understood that while the power supply 180 can take several different forms, it will generally require the use of a relatively large, massive structure that is disposed and supported within the main housing 110 of the lantern 100 and braced against the rear wall 113 of the main housing 110. The exemplary power supply structure shown in FIGS. 1–3 is that of a pair of standard 6-volt batteries. The bracing arrangement 170 comprises a pair of expansive elements 171 that are configured to be compressed between the rear surface 146 of the LED mounting plate 141 and the forward-facing sides of the batteries 181. The expansive elements 171 are preferably formed as compressible elastomeric blocks that provide an outwardly-directed expansion force proportional to the degree of compression the blocks. In an exemplary embodiment, the expansive elements 171 are formed from elastomeric foam blocks having an uncompressed thickness of about 1.0 inch. When disposed in the assembled lantern 100, these blocks may be compressed to a thickness of less than 0.5 inches.

It will be understood that other types of expansive elements 171 such as springs or spring-loaded devices may also be used.

In some less preferred embodiments of the invention, the bracing arrangement 170 can incorporate non-expansive components to brace the illuminator assembly 140 against rearward movement. If disposed intermediate the illuminator assembly 140 and one or more power supply components, the bracing arrangement 170 will also restrict or prevent forward movement of those components.

The lantern 100 may be constructed for either portable or fixed uses. As shown in FIGS. 1–3, the lantern 100 may include a handle 121 attached to the case 102 to facilitate portability. Alternatively or in addition the lantern 100 may include brackets or other fixtures (not shown) that facilitate attachment of the lantern to walls, bulkheads, shelves or other support structures.

Although primarily directed to military requirements for a standard approximately 6"×6"×6" lantern, the embodiments of the invention are not limited to this size. Both larger and smaller lanterns may be constructed that make use of the innovations of the invention.

Prototype lanterns according to embodiments of the invention have demonstrated their superiority and flexibility as compared to standard incandescent lamp lanterns. Exemplary lanterns 100 using a variety of LED arrays have demonstrated greater than 200% improvement in battery life and have been subjected to shock loads on the order of 150–250 g (1471–1961 m/sec$^2$) with no degradation in their operative characteristics. Additional battery life improvements are likely based on anticipated improvements in sold-state lighting technology. Further, these lanterns have demonstrated continued effective operation with zero leakage while submerged in 15 feet of water. These improvements are directly attributable at least in part to the invention's LED-based illuminator assembly and its novel supporting structure.

Other embodiments and uses of the invention will be apparent to those skilled in the art from consideration of the specification and practice of the invention disclosed herein. The specification and examples should be considered exemplary only. The scope of the invention is limited only by the claims appended hereto.

What is claimed is:

1. A lantern comprising:

a case having a plurality of walls defining a case interior, the plurality of walls including opposing front and rear walls;

a lighting port formed through the front wall;

a faceplate assembly disposed in the case interior in substantial registration with the lighting port and with the faceplate assembly engaging a portion of the front wall surrounding the lighting port to seal the lighting port;

a solid-state illuminator assembly disposed in the case interior in substantial registration with the faceplate assembly, the solid-state illuminator assembly being in contact with the faceplate assembly; and a bracing arrangement disposed intermediate the solid-state illuminator assembly and the rear wall, the bracing arrangement being in contact with the solid-state illuminator assembly and being configured to restrict rearward movement of the solid-state illuminator assembly and the faceplate assembly, wherein the faceplate assembly comprises:

a substantially transparent faceplate having forward and rearward faceplate surfaces and a faceplate circumference, the faceplate being substantially planar and being sized and configured to cover and close the lighting port from the case interior, and an elastomeric faceplate seal disposed around the circumference of the faceplate, the faceplate seal having a forward lip in contact with the forward faceplate surface and a rear lip in contact with the rearward faceplate surface.

2. A lantern according to claim 1 wherein the lighting port is substantially circular and wherein the faceplate is formed as a substantially circular disc.

3. A lantern according to claim 1 wherein the solid-state illuminator assembly comprises a mounting plate having a front mounting plate surface and a rear mounting plate surface, and at least one LED assembly attached to the front surface of the mounting plate, the LED assembly comprising an LED in electrical communication with a power supply, the solid-state illuminator assembly being disposed in the case interior so that the mounting plate is parallel to and in substantial registration with the faceplate and so that the LED of the at least one LED assembly is in contact with the rear faceplate surface and the bracing arrangement is in contact with the rear mounting plate surface.

4. A lantern according to claim 1 wherein the faceplate is formed from one of the group consisting of tempered glass, polycarbonate and acrylic resins.

5. A lantern according to claim 1 wherein the faceplate has a thickness in a range from about 0.0625 in. to about 0.5000 in.

6. A lantern according to claim 1 wherein the faceplate has a thickness in a range from about 0.25 in. to about 0.40 in.

7. A lantern according to claim 1 wherein the faceplate is tinted so that light transmitted through the faceplate takes on a predetermined color.

8. A lantern according to claim 3 wherein the mounting plate is formed as a substantially circular disc.

9. A lantern according to claim 3 wherein the LED has a substantially flat LED forward surface in contact with the rear faceplate surface.

10. A lantern according to claim 3 wherein the solid-state illuminator assembly comprises a plurality of LED assemblies each comprising an LED in communication with the power supply and in contact with the rear faceplate surface.

11. A lantern according to claim 3 further comprising:

a retainer attached to the front wall, the retainer having a front surface in engagement with the rear lip of the faceplate seal and having a retainer passage in substantial registration with the faceplate, the retainer passage being sized and configured to slidably receive the solid-state illuminator assembly, wherein the solid-state illuminator assembly is disposed within the retainer passage.

12. A lantern comprising:

a case having a plurality of walls defining a case interior, the plurality of walls including opposing front and rear walls;

a lighting port formed through the front wall;

a substantially transparent faceplate having forward and rearward faceplate surfaces and a faceplate circumference, the faceplate being substantially planar and being sized and configured to cover and close the lighting port from the case interior;

an elastomeric faceplate seal disposed around the circumference of the faceplate, the faceplate seal having a forward lip in contact with the forward faceplate surface and a rear lip in contact with the rearward faceplate surface, the faceplate and faceplate seal being disposed in the case interior in substantial registration with the lighting port and so that the faceplate seal engages a portion of the front wall surrounding the lighting port;

at least one LED assembly attached to a mounting plate having a front mounting plate surface and a rear mounting plate surface, the LED assembly extending forwardly from the front mounting plate surface and comprising an LED in electrical communication with a power supply, the mounting plate being disposed in the case interior parallel to and in substantial registration with the faceplate and so that the LED of the at least one LED assembly is in contact with the rear faceplate surface; and at least one expansive element disposed intermediate the mounting plate and the rear wall, the at least one expansive element being in contact with the rear mounting plate surface and being disposed in a compressed state such that the expansive element applies a forwardly-directed load through the mounting plate to the at least one LED assembly, which transmits the forwardly-directed load to the faceplate assembly.

13. A lantern according to claim 12 wherein the at least one expansive element includes an elastomeric foam block.

14. A lantern according to claim 12 wherein at least a portion of the power supply is disposed in the case interior adjacent to and in contact with the rear wall and wherein the at least one expansive element is disposed intermediate the illuminator assembly and the at least a portion of the power supply and is in contact with the at least a portion of the power supply, the expansive element being disposed such that the expansive element applies a rearwardly-directed load to the at least a portion of the power supply.

15. A lantern according to claim 12 wherein the faceplate and faceplate seal maintain a substantially water-tight seal of the lighting port when the lantern is submerged in water to a depth of at least 15 feet.

16. A lantern according to claim 12 wherein the LED has a substantially flat LED forward surface in contact with the rear faceplate surface.

17. A lantern according to claim 12 wherein the illuminator assembly comprises a plurality of LED assemblies each comprising an LED in communication with the power supply and in contact with the rear faceplate surface.

18. A lantern according to claim 12 wherein the lighting port is substantially circular and wherein the faceplate is formed as a substantially circular disc.

19. A lantern according to claim 12 wherein the faceplate is formed from one of the group consisting of tempered glass, polycarbonate and acrylic resins.

20. A lantern according to claim 12 wherein the faceplate has a thickness in a range from about 0.0625 in. to about 0.5000 in.

21. A lantern according to claim 12 wherein the faceplate is tinted so that light transmitted through the faceplate takes on a predetermined color.

22. A lantern according to claim 12 wherein the case comprises a main housing and a removable front cover, the front cover including the front wall, the lantern further comprising a case seal intermediate the front cover and the main housing.

23. A lantern according to claim 12 wherein the case is formed as a rectangular block having opposing top and bottom walls and opposing side walls intermediate to and connected to the front and rear walls.

* * * * *